US006881102B2

(12) United States Patent
Correll et al.

(10) Patent No.: US 6,881,102 B2
(45) Date of Patent: Apr. 19, 2005

(54) TERMINAL LOCKING MECHANISM FOR HYBRID ELECTRICAL CONNECTOR

(75) Inventors: Michael A. Correll, Middletown, PA (US); Daniel R. Ringler, Elizabethville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 3 days.

(21) Appl. No.: 10/460,884

(22) Filed: Jun. 13, 2003

(65) Prior Publication Data

US 2004/0253879 A1 Dec. 16, 2004

(51) Int. Cl.[7] ..... H01R 13/514
(52) U.S. Cl. ..... 439/752
(58) Field of Search ..... 439/752, 595

(56) References Cited

U.S. PATENT DOCUMENTS 3,766,513 A 10/1973 Carre ..... 339/31 R
4,750,893 A 6/1988 Sueyoshi et al. ..... 439/596
4,867,705 A 9/1989 Yuasa ..... 439/595
5,203,722 A 4/1993 Kinoshita ..... 439/595
5,785,557 A 7/1998 Davis ..... 439/660
5,984,737 A * 11/1999 Nagano et al. ..... 439/752
6,027,374 A * 2/2000 Nagai et al. ..... 439/596
6,270,376 B1 * 8/2001 Fink et al. ..... 439/595
6,435,919 B1 * 8/2002 Saka et al. ..... 439/752

FOREIGN PATENT DOCUMENTS

EP 0 951 102 A2 10/1999

* cited by examiner

*Primary Examiner*—Gary Paumen

(57) ABSTRACT

A hybrid electrical connector includes both signal and power contacts in the same connector housing. The housing includes a plurality of axially extending passageways for receipt of the signal contacts and a plurality of axially extending cavities for receipt of the power contacts. The connector housing further includes a plurality of transversely extending slots extending through the connector housing intersecting with individual power contact cavities. A Y-shaped terminal retaining member is insertable in the slots and is resiliently held in place in the slots. The power terminals include an opening therethrough forming a locking shoulder for receipt of the transversely extending locking member.

20 Claims, 6 Drawing Sheets

TERMINAL LOCKING MECHANISM FOR HYBRID ELECTRICAL CONNECTOR

The subject invention relates to an improved electrical connector housing and more particularly to an improved secondary retention feature for the retention of electrical terminals within their housing.

BACKGROUND OF THE INVENTION

It is quite common in the electrical connector industry today to require that electrical terminals have redundant retention means within their connector housings. The first or primary means of retaining the electrical terminals within the housing is to have a stamped-out lance from the electrical terminal metal body, which abuts a shoulder within the housing. The redundant or secondary retention means is typically profiled as a plastic movable member, which can be moved into place over the terminal to lock the terminal in place. Some of these members are moved transversely of the axial direction, while some are defined as hinged flaps, which are rotated into place. These flaps include plastic tabs which, when rotated, reside in a groove or gap within the terminal to retain the contact in place.

In one prior method, as shown for example in U.S. Pat. No. 4,750,893, an electrical connector housing has a hinged flap which rotates into place. The electrical connector has an insulating housing and a plurality of electrical terminals disposed in terminal receiving passageways within the housing. The housing includes an upper retention flap including a retention tab which, when in its locked location, is positioned adjacent to an edge of the terminal to retain the terminal in the passageway. The flap has tabs which reside at an edge of the contact to prevent withdrawal thereof. If more than one row of contacts is present, then two hinged flaps on the outside of each of the two rows are used to retain the terminals in place.

It is also well known in the industry to provide a hybrid electrical connection system, comprised of both signal and power contacts. See, for example, U.S. Pat. No. 5,785,557 and EP Patent Application 0951102. In particular with hybrid connectors, given the complexity and cost, it is desirable to be able to remove and/or replace contacts within the connector without destroying or damaging the electrical connector or any of the connections thereto.

The objects of the invention are therefore to improve upon these known connection systems.

SUMMARY OF THE INVENTION

The objects of the invention have been accomplished by providing an electrical connector, comprising an insulative housing having at least one contact receiving cavity therethrough, the housing having a transversely extending slot intersecting the cavity. At least one electrical terminal is positioned in the cavity, the terminal having a locking shoulder adjacent to the transversely extending slot. A terminal locking member also has resilient fork members, the resilient fork members having locking members, and the resilient fork members being resiliently biasable into a locked position within the transversely extending slot, with a portion of the terminal locking member engaging the locking shoulder of the terminal, thereby retaining the terminal in the cavity.

Preferably, the terminal locking member is Y-shaped, and comprises two locking forks having latching members thereon, for latching the forks in the slot. The terminal has a front U-shaped contact section defined by two side-by-side contact plates interconnected by a bight portion, the bight portion having an opening therethrough defining the locking shoulder. The Y-shaped terminal locking member further comprises a leg portion, which extends through the bight portion opening. The housing further comprises a central rib extending intermediate the side-by-side contact plates, opposite the bight portion with the side-by-side contact plates flanking the central rib, the central rib terminating to form a forwardly facing shoulder adjacent to the bight portion opening. The terminal locking member extends through the transversely extending slot and the bight portion opening, with the leg portion positioned forward of the forwardly facing shoulder, thereby locking the electrical terminal in place.

In another aspect of the invention, an electrical connector comprises an insulative housing having at least one contact receiving cavity therethrough, the housing having a transversely extending slot intersecting the cavity. At least one electrical terminal is positioned in the cavity, the terminal having a front U-shaped contact section defined by two side-by-side contact plates interconnected by a bight portion, the bight portion having an opening therethrough defining a locking shoulder. A central rib is defined in the insulative housing and extends intermediate the side-by-side contact plates, opposite the bight portion with the side-by-side contact plates flanking the central rib, the central rib terminating to form a forwardly facing shoulder adjacent to the bight portion opening. A terminal locking member extends through the transversely extending slot, the bight portion opening, and is positioned forward of the forwardly facing shoulder, thereby locking the electrical terminal in place.

Preferably, the terminal locking member has resilient fork members having locking members, and the resilient fork members are resiliently biasable into a locked position within the transversely extending slot. The terminal locking member is Y-shaped, and the Y-shaped terminal locking member comprises two locking forks having latching members thereon, for latching the forks in the slot. The Y-shaped terminal locking member further comprises a leg portion, which extends through the bight portion opening.

The plurality of electrical terminals are alternately positioned within the housing with some of the terminal bight portions along a lower side of the cavities, and some of the terminal bight portions positioned along an upper side of the cavities; and a plurality of central ribs are alternately positioned in the housing to cooperate with the terminals.

In yet another aspect of the invention, an electrical connector comprises an insulative housing having at least one contact receiving cavity therethrough, the housing having a transversely extending slot intersecting the cavity. At least one electrical terminal is positioned in the cavity, the terminal having a front U-shaped contact section defined by two side-by-side contact plates interconnected by a bight portion. The terminal has an opening therethrough extending through the bight portion and partially into the side-by-side contact plates defining a locking shoulder. A terminal locking member extends through the transversely extending slot and the opening, the terminal locking member is longitudinally locked in the transversely extending slot and within the opening, thereby locking the electrical terminal in place.

The terminal locking member is Y-shaped, and comprises two locking forks having latching members thereon, for latching the forks in the slot. The Y-shaped terminal locking member further comprises a leg portion, which extends through the bight portion opening.

The insulative housing further comprises a central rib extending intermediate the side-by-side contact plates, opposite the bight portion with the side-by-side contact plates flanking the central rib, the central rib terminating to form a forwardly facing shoulder adjacent to the bight portion opening. The terminal locking member extends through the transversely extending slot, the bight portion opening, with the leg portion positioned forward of the forwardly facing shoulder, thereby locking the electrical terminal in place. The terminal locking member is Y-shaped and comprises two locking forks having latching members thereon, for latching the forks in the slot. The Y-shaped terminal locking member further comprises a leg portion, which extends through the bight portion opening, and is positioned forwardly of the forwardly facing shoulder. The electrical connector can also comprise a plurality of electrical terminals, where the terminals are alternately positioned within the housing with some of the terminal bight portions along a lower side of the cavities, and some of the terminal bight portions positioned along an upper side of the cavities, and a plurality of central ribs, alternately positioned in the housing to cooperate with the terminals.

DETAILED DESCRIPTION OF THE PREFERRED EMBODIMENT

Figure 1:
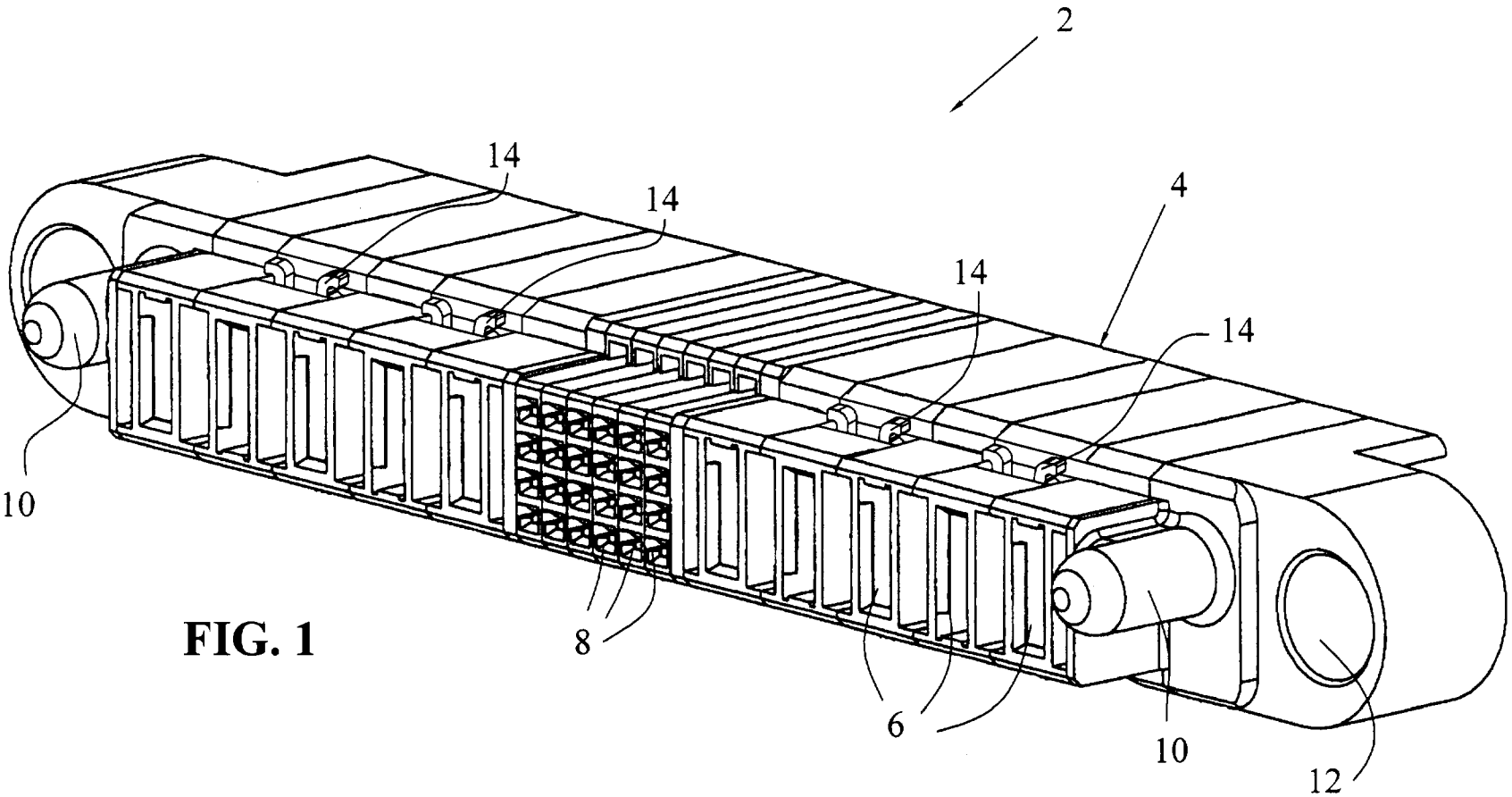
FIG. 1 is a perspective view showing the hybrid electrical connector of the present invention.
Figure 2:
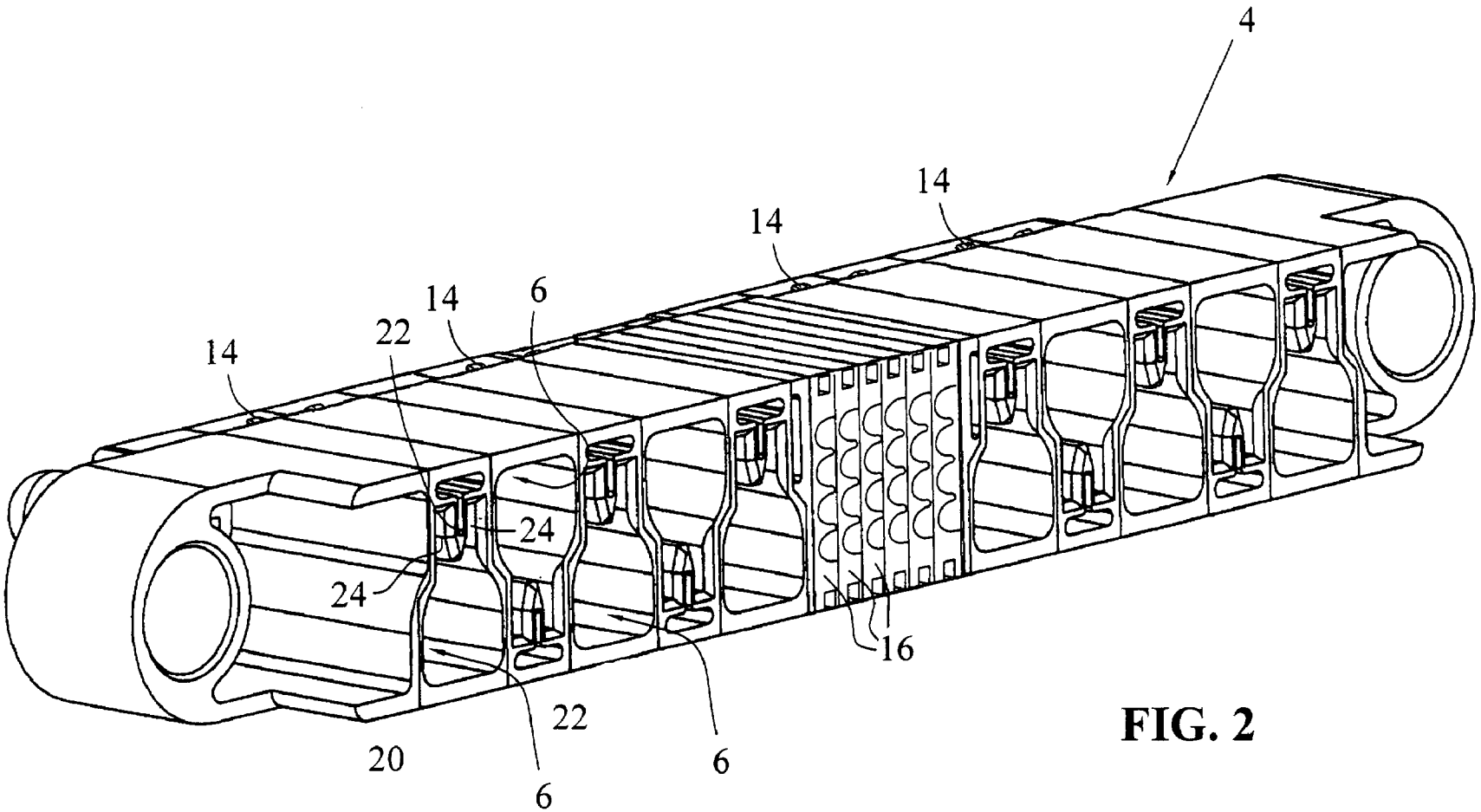
FIG. 2 is a rear perspective view of the connector of FIG. 1.

With reference first to FIG. 1, a connector is shown at 2 as a hybrid electrical connector, having a housing 4 with a plurality of contact cavities 6 for receipt of power contacts, and a plurality of contact receiving cavities 8 for receipt of signal contacts. The housing 4 further includes polarizing lugs at 10 and mounting apertures at 12. With reference still to FIG. 1, the power terminal receiving cavities include terminal locking members 14 snapped in place to retain the terminals in the individual passageways 6, as will be described further herein. As shown in FIG. 2, a rear perspective view of the connector housing 4 is shown, where the power terminal receiving cavities 6 are shown in greater detail, as will be described herein. Finally, the connector housing 4 includes a plurality of locking inserts 16 to lock the signal contacts in place, which are further described in co-pending patent application Ser. No. 10/460,900, filed on even date herewith, and incorporated herein by reference.

Figure 3:
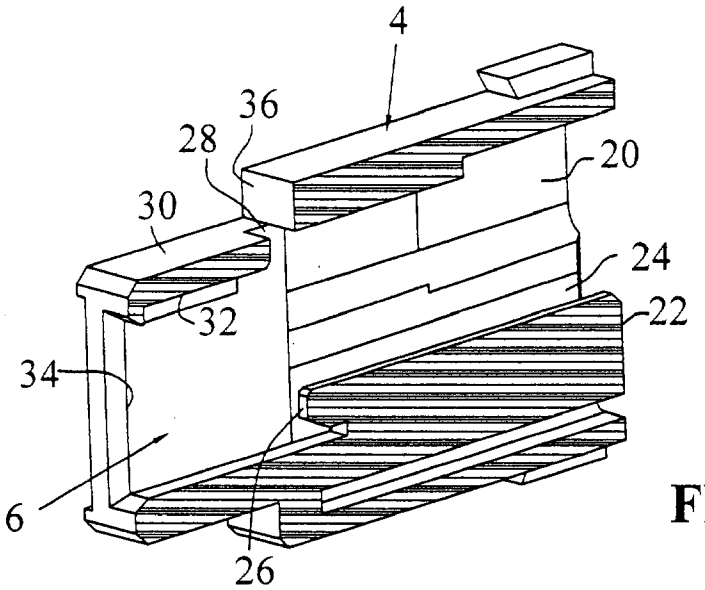
FIG. 3 is a fragmentary cross-sectional view through the cavity for the power terminal of the present invention.

With reference to FIGS. 2 and 3, the detail of the power cavities 6 will be described in greater detail. As shown in FIG. 2, each of the cavities 6 include an enlarged opening portion 20 having rib portions 22 positioned opposite the enlarged portions 20. The rib portion is positioned centrally so as to define two slot portions at 24, which flank the rib 22. As shown best in FIG. 3, the central rib 22 terminates in a forwardly facing shoulder at 26, as will be described herein. As also shown best in FIG. 3, the housing 4 includes a slot at 28, which extends transversely of the longitudinal axis of the cavity 6 and intersects with the cavity to communicate therewith. It should be noted that a rear surface 36 defining the cavity 28 is proximate to the forwardly facing shoulder 26. Slot 28 extends through top surface 30 of housing 4 and through inner surface 32 of housing 4.

Figure 4:
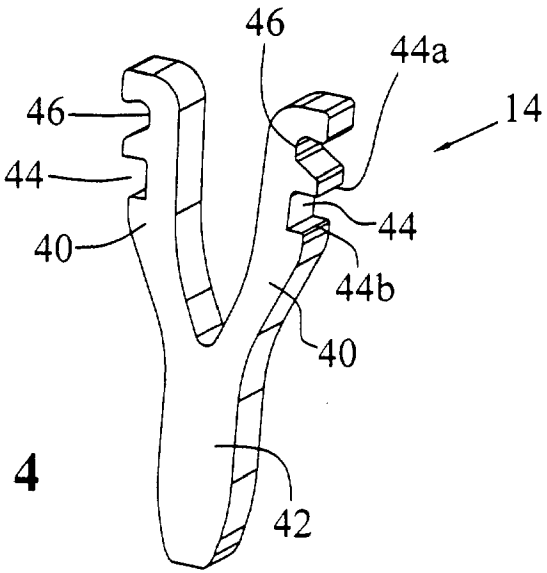
FIG. 4 is a perspective view of the terminal locking mechanism shown in FIGS. 3 and 4.
Figure 6:
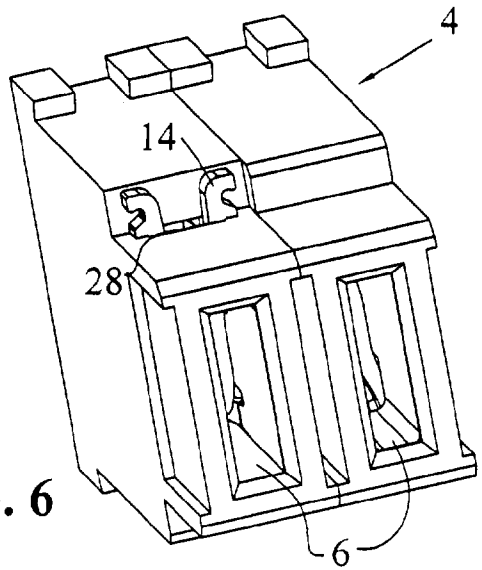
FIG. 6 is a view similar to that of FIG. 5, showing the terminal locking member in full position.

With respect now to FIG. 4, terminal locking member 14 is shown in greater detail. Terminal locking member 14 is Y-shaped in configuration, including two resilient fork members 40 and a lower leg portion 42. Each of the fork members 40 are resiliently biasable inwardly and include locking members at 44. The locking members 44 are defined by upper and lower surfaces 44*a* and 44*b*, which are spaced apart slightly greater than the distance between surfaces 30 and 32 of the housing member 4 (FIG. 3). The terminal locking member 14 further includes gripping area 46 for removal of the terminal locking member 14, as described herein.

Figure 8:
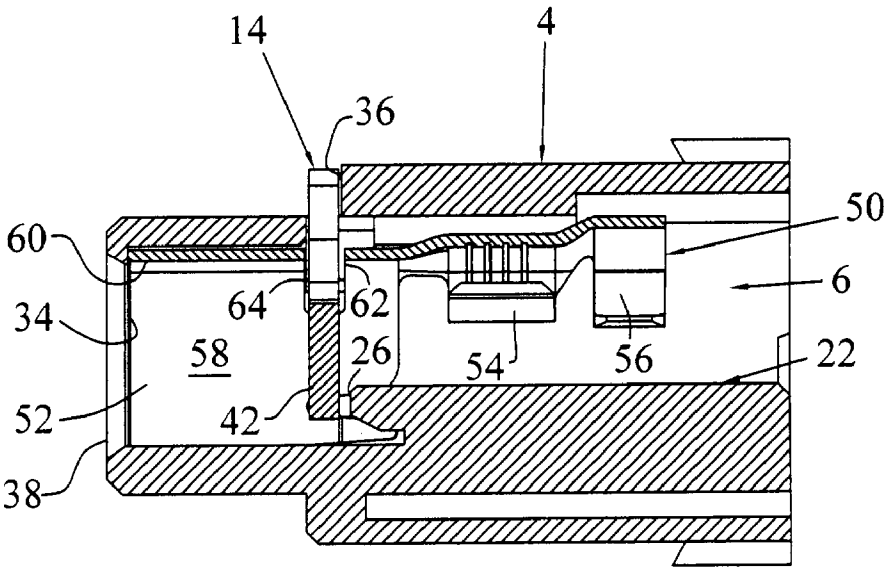
FIG. 8 is a cross-sectional view through lines 8—8 of FIG. 7.

With respect now to FIG. 8, an electrical terminal 50 is shown as a power terminal, generally comprised of a front contact portion 52, a crimp barrel 54, and a strain relief member at 56. The front contact portion 52 is generally comprised of a contact having a U-shaped cross-section, generally comprised of side-by-side parallel contact plates 58 (only one of which is shown in FIG. 8) connected together by way of a bight portion 60. As shown in FIG. 8, the terminal 50 also includes an opening 62, which extends through the bight portion 60 and partially into the side-by-side contact plates 58, thereby defining a retaining and locking shoulder 64 on the terminal 50. With the above elements as described, the assembly and application of the connector will now be described in detail.

With respect first to FIGS. 2 and 8, it should be appreciated that the conductors for the power are terminated to contacts in a conventional manner, that is, by stripping the end of the insulation, then placing the bared conductors in the crimp barrel portion 54 of the terminals and crimping the conductors to the crimp barrel, at the same time applying the strain relief 56 around the insulation of the wire. As shown in FIG. 2, the connector is designed to accommodate 10 power conductors, and therefore 10 such terminals would be prepared. It is also evident from FIG. 2 that some of the cavities 6 for receiving the power terminals are inverted relative to each other, and that the enlarged opening portion 20 is to receive the crimp barrel strain relief and conductor therein.

Figure 5:
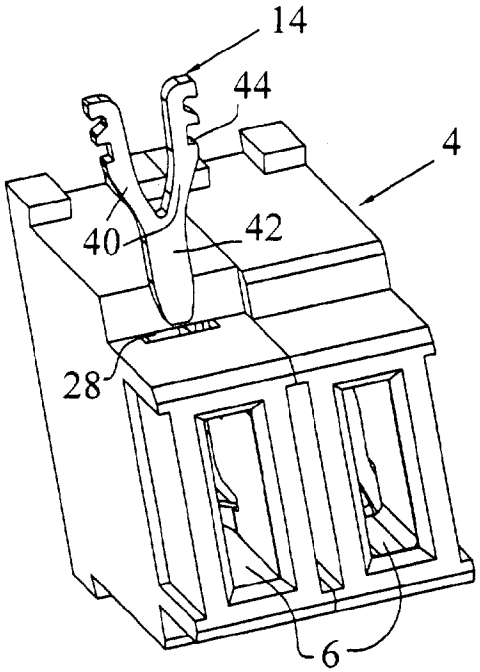
FIG. 5 is a fragmentary perspective view showing the terminal locking member of the power terminal cavities poised for receipt in its respective slot.

Therefore, the terminals 50, when prepared, are inserted such that the side-by-side contact plates are positioned in the slots 24, with the contact plates flanking the rib 22 and are slidably received therein, with the bight portion 60 positioned on a lower surface of the enlarged opening 20. Thus, when the terminals 50 are fully positioned in their cavities 6, a front edge of the contact plates 58 abut the corresponding shoulder 34 of housing 4 to locate the terminals therein. When in this position, and as shown in FIG. 5, the retaining members 14 can be received transversely into the slot 28, which then causes leg 42 to communicate within the cavity 6 and lock terminals 50 in place, as to be described.

Figure 7:
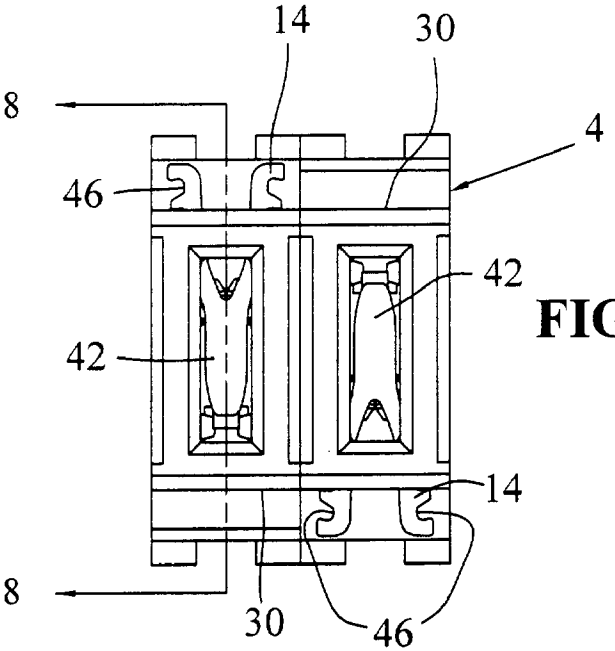
FIG. 7 is a front plan view of two of the power terminal cavities.

It should also be appreciated from FIGS. 7 and 8 that, when terminal 50 is fully positioned as described above, and as retaining member 14 is fully positioned as shown in FIG. 8, the yoke members 40 of retaining member 14 project into the portion of opening 62, which extends into the opposed contact plates 58, while the leg portion 42 extends between the side-by-side contact plates and is positioned adjacent to the forwardly facing surface 26 of rib 22. Thus, as shown in FIG. 8, the power terminals are fixedly held in place in their corresponding cavities 6 by the retaining members 14.

For example, if a strain is placed on the conductors towards the right as viewed in FIG. 8, the locking surface 64 of opening 62 would cause an abutment against the retaining member 14. Retaining member 14 is held fixed against surface 36, and even leg portion 42 is backed up by forwardly facing surface 26 of rib member 22.

It should also be appreciated from FIG. 7 that the retaining members 14 extend in alternate directions, such that one retaining member extends with the leg portion 42 extending downwardly, whereas an adjacent or alternate cavity has a retaining member 14, with the leg portion 42 extending upwardly. This is consistent with the alternate staggering of the contact cavity 6 as shown in FIG. 2. It should also be appreciated from FIG. 4 that the portions 46 of the retaining members 14 are exterior to surface 30, such that a common gripping tool, such as standard hook-nose tweezers, can be used for extracting the retaining meters 14.

Figure 10:
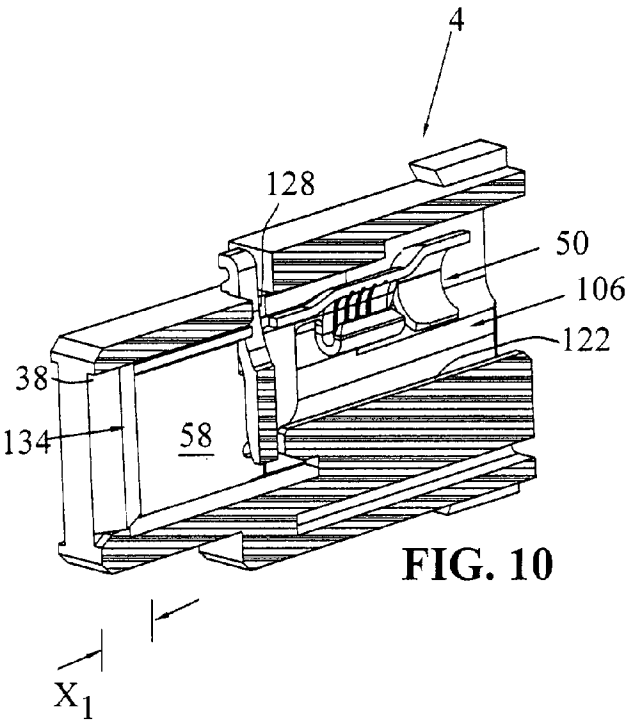
FIG. 10 is a perspective view similar to that of FIG. 9, showing the power terminal staggered further rearwardly.
Figure 9:
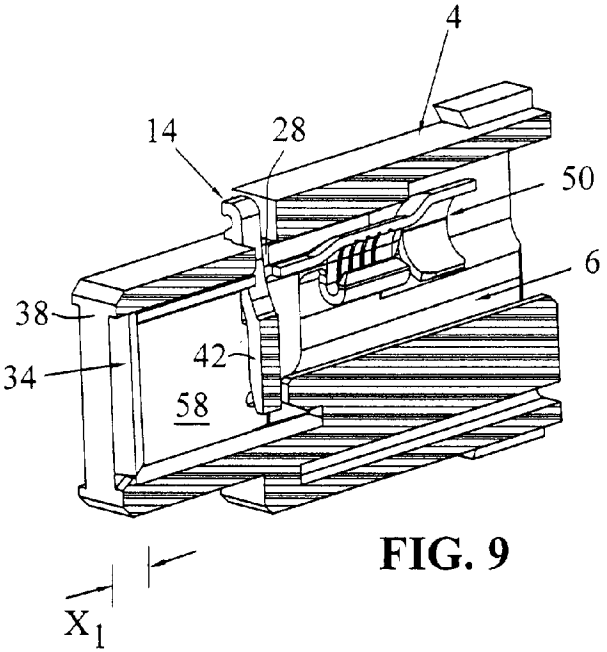
FIG. 9 is a cut-away perspective view through the power contact and associated cavity, similar to that shown in FIG. 8.

With reference now to FIGS. 9 and 10, it should be appreciated that various cavities are staggered, from the front face 38 to a front edge of the contact plate 58. For example, as shown in FIG. 9, the front edge of the contact plate 58 is positioned a distance $X_1$ from the front faced 38 of the housing 4. With respect now to FIG. 10, other power cavities can be configured as shown at 106, with a shoulder such as 134 positioned further inwardly than shoulder 34, such that the front edge of contact plate 58 is positioned a distance $X_2$ from the front edge 38 of housing 4, to perform a first-mate, last-break sequencing of the power terminals. Contacts 50 are modified slightly in the length of the contact plate 58 to accommodate this difference.

In the preferred embodiment, the dimensions $X_1$ and $x_2$ are on the order of 0.035 inches and 0.073 inches, respectively.

What is claimed is:

1. An electrical connector, comprising:

an insulative housing having at least one contact receiving cavity therethrough, said housing having a transversely extending slot intersecting said cavity;

at least one electrical terminal positioned in said cavity, said terminal having a front U-shaped contact section defined by two side-by-side contact plates interconnected by a bight portion, said bight portion having an opening therethrough defining a locking shoulder adjacent to said transversely extending slot; and a terminal locking member having resilient fork members, said resilient fork members having locking members, and said resilient fork members being resiliently biasable into a locked position within said transversely extending slot, with a portion of said terminal locking member extending through said opening and engaging said locking shoulder of said terminal, thereby retaining said terminal in said cavity.

2. The electrical connector of claim 1, wherein said terminal locking member is Y-shaped.

3. The electrical connector of claim 2, wherein said Y-shaped terminal locking member comprises two locking forks having latching members thereon, for latching the forks in said slot.

4. The electrical connector of claim 3, wherein said Y-shaped terminal locking member further comprises a leg portion which extends through said bight portion opening.

5. The electrical connector of claim 4, wherein said insulative housing further comprises a central rib extending intermediate said side-by-side contact plates, opposite said bight portion with said side-by-side contact plates flanking said central rib, said central rib terminating to form a forwardly facing shoulder adjacent to said bight portion opening.

6. The electrical connector of claim 5, wherein said terminal locking member extends through said transversely extending slot and said bight portion opening, with said leg portion positioned forward of said forwardly facing shoulder, thereby locking said electrical terminal in place.

7. An electrical connector, comprising:

an insulative housing having at least one contact receiving cavity therethrough, said housing having a transversely extending slot intersecting said cavity;

at least one electrical terminal positioned in said cavity, said terminal having a front U-shaped contact section defined by two side-by-side contact plates interconnected by a bight portion, said bight portion having an opening therethrough defining a locking shoulder;

a central rib defined in said insulative housing and extending intermediate said side-by-side contact plates, opposite said bight portion with said side-by-side contact plates flanking said central rib, said central rib terminating to form a forwardly facing shoulder adjacent to said bight portion opening; and a terminal locking member extending through said transversely extending slot, said bight portion opening, and positioned forward of said forwardly facing shoulder, thereby locking said electrical terminal in place.

8. The electrical connector of claim 7, wherein said terminal locking member has resilient fork members, said resilient fork members having locking members, and said resilient fork members being resiliently biasable into a locked position within said transversely extending slot.

9. The electrical connector of claim 7, wherein said terminal locking member is Y-shaped.

10. The electrical connector of claim 9, wherein said Y-shaped terminal locking member comprises two locking forks having latching members thereon, for latching the forks in said slot.

11. The electrical connector of claim 10, wherein said Y-shaped terminal locking member further comprises a leg portion which extends through said bight portion opening.

12. The electrical connector of claim 7, comprising a plurality of electrical terminals, said terminals being alternately positioned within said housing with some of said terminal bight portions along a lower side of said cavities, and some of said terminal bight portions positioned along an upper side of said cavities, and a plurality of central ribs, alternately positioned in said housing to cooperate with said terminals.

13. An electrical connector, comprising:

an insulative housing having at least one contact receiving cavity therethrough, said housing having a transversely extending slot intersecting said cavity;

at least one electrical terminal positioned in said cavity, said terminal having a front U-shaped contact section defined by two side-by-side contact plates interconnected by a bight portion, said terminal having an opening therethrough, and extending through said bight portion and partially into said side-by-side contact plates defining a locking shoulder; and a Y-shaped terminal locking member extending through said transversely extending slot, and said opening, said, terminal locking member being longitudinally locked in said transversely extending slot and within said opening, thereby locking said electrical terminal in place.

14. The electrical connector of claim 13, wherein said Y-shaped terminal locking member comprises two locking forks having latching members thereon, for latching the forks in said slot.

15. The electrical connector of claim 14, wherein said Y-shaped terminal locking member further comprises a leg portion which extends through said bight portion opening.

16. The electrical connector of claim 13, wherein said insulative housing further comprises a central rib extending intermediate said side-by-side contact plates, opposite said bight portion with said side-by-side contact plates flanking said central rib, said central rib terminating to form a forwardly facing shoulder adjacent to said bight portion opening.

17. The electrical connector of claim 16, wherein said terminal locking member extends through said transversely extending slot and said bight portion opening, with said leg portion positioned forward of said forwardly facing shoulder, thereby locking said electrical terminal in place.

18. The electrical connector of claim 17, wherein said terminal locking member is Y-shaped and comprises two locking forks having latching members thereon, for latching the forks in said slot.

19. The electrical connector of claim 18, wherein said Y-shaped terminal locking member further comprises a leg portion which extends through said bight portion opening, and is positioned forwardly of said forwardly facing shoulder.

20. The electrical connector of claim 16, comprising a plurality of electrical terminals, said terminals being alternately positioned within said housing with some of said terminal bight portions along a lower side of said cavities, and some of said terminal bight portions positioned along an upper side of said cavities, and a plurality of central ribs, alternately positioned in said housing to cooperate with said terminals.

* * * * *